US009475167B2

(12) United States Patent
Maruyama et al.

(10) Patent No.: US 9,475,167 B2
(45) Date of Patent: Oct. 25, 2016

(54) POLISHING APPARATUS HAVING TEMPERATURE REGULATOR FOR POLISHING PAD

(75) Inventors: Toru Maruyama, Tokyo (JP); Tadakazu Sone, Tokyo (JP); Yasuyuki Motoshima, Tokyo (JP)

(73) Assignee: Ebara Corporation, Tokyo (JP)

( * ) Notice: Subject to any disclaimer, the term of this patent is extended or adjusted under 35 U.S.C. 154(b) by 442 days.

(21) Appl. No.: 13/397,908

(22) Filed: Feb. 16, 2012

(65) Prior Publication Data

US 2012/0220196 A1 Aug. 30, 2012

(30) Foreign Application Priority Data

Feb. 25, 2011 (JP) ..... 2011-039586

(51) Int. Cl.
*B24B 37/015* (2012.01)
*B24B 37/04* (2012.01)

(52) U.S. Cl.
CPC ..... *B24B 37/04* (2013.01); *B24B 37/015* (2013.01)

(58) Field of Classification Search
USPC ..... 451/7, 53; 438/5
See application file for complete search history.

(56) References Cited

U.S. PATENT DOCUMENTS 2,997,312 A * 8/1961 Muller et al. ..... 280/124.136
3,516,522 A * 6/1970 Chamberlain ..... 188/264 D
3,592,298 A * 7/1971 Leffert et al. ..... 188/71.6
4,088,266 A * 5/1978 Keyes ..... 126/617
5,355,945 A * 10/1994 Sanz et al. ..... 165/159
5,447,195 A * 9/1995 Luyts ..... 165/159
5,582,245 A * 12/1996 Niimi ..... 165/166
5,879,576 A * 3/1999 Wada ..... B05C 11/08 156/345.21
6,012,967 A 1/2000 Satake et al.
6,631,077 B2 * 10/2003 Zuo ..... 361/699
6,827,638 B2 * 12/2004 Kiuchi ..... B24B 37/015 451/287
7,126,822 B2 * 10/2006 Hu et al. ..... 361/699
7,353,920 B2 * 4/2008 Nowak et al. ..... 188/71.6
7,374,027 B2 * 5/2008 Mayberry et al. ..... 188/264 D
7,766,134 B2 * 8/2010 Mayberry et al. ..... 188/264 CC
7,837,534 B2 * 11/2010 Aiyoshizawa et al. ..... 451/7
7,882,624 B2 * 2/2011 Hu et al. ..... 29/832
8,211,242 B2 * 7/2012 Inoue ..... B08B 1/04 134/102.2
8,269,341 B2 * 9/2012 Barth ..... 257/714
2002/0039280 A1 * 4/2002 O'Connor et al. ..... 361/690
2003/0024488 A1 * 2/2003 Bingham et al. ..... 122/235.16

(Continued)

FOREIGN PATENT DOCUMENTS

JP 05-237761 9/1993
JP 2006-074060 3/2006

(Continued)

*Primary Examiner* — Joseph J Hail
*Assistant Examiner* — Brian Keller
(74) *Attorney, Agent, or Firm* — Baker & Hostetler LLP

(57) ABSTRACT

A substrate polishing apparatus includes: a polishing table supporting a polishing pad; a top ring configured to press the substrate against the polishing pad; and a pad temperature regulator configured to regulate a surface temperature of the polishing pad. The pad temperature regulator includes a pad contact element and a liquid supply system configured to supply a temperature-controlled liquid to the pad contact element. The pad contact element has a space therein and a partition that divide the space into a first liquid passage and a second liquid passage that are connected in series. At least one baffle substantially perpendicular to a radial direction of the polishing table is provided in each of the first liquid passage and the second liquid passage.

11 Claims, 12 Drawing Sheets

(56) References Cited

U.S. PATENT DOCUMENTS

| | | | | |
|---|---|---|---|---|
| 2003/0186623 | A1* | 10/2003 | Pham et al. | 451/7 |
| 2004/0087248 | A1* | 5/2004 | Hirokawa | 451/7 |
| 2004/0195110 | A1* | 10/2004 | Emesh et al. | 205/652 |
| 2005/0112998 | A1* | 5/2005 | Matsuo et al. | 451/5 |
| 2005/0284606 | A1* | 12/2005 | Stahl | 165/58 |
| 2006/0147741 | A1* | 7/2006 | Ho et al. | 428/544 |
| 2006/0151110 | A1* | 7/2006 | Laursen et al. | 156/345.12 |
| 2007/0298692 | A1* | 12/2007 | Mavliev et al. | 451/56 |
| 2008/0047786 | A1* | 2/2008 | Nowak et al. | 188/71.6 |
| 2008/0166885 | A1* | 7/2008 | Redeker et al. | 438/768 |
| 2008/0311823 | A1* | 12/2008 | Aiyoshizawa et al. | 451/7 |
| 2010/0081360 | A1* | 4/2010 | Xu et al. | 451/5 |
| 2010/0151771 | A1* | 6/2010 | Nabeya | 451/7 |
| 2010/0203815 | A1* | 8/2010 | Bajaj | 451/446 |
| 2010/0218931 | A1* | 9/2010 | Stahl | 165/185 |
| 2010/0279435 | A1* | 11/2010 | Xu et al. | 438/5 |
| 2010/0285723 | A1* | 11/2010 | Lin et al. | 451/5 |
| 2011/0159782 | A1* | 6/2011 | Sone et al. | 451/7 |
| 2012/0220196 | A1* | 8/2012 | Maruyama et al. | 451/7 |
| 2013/0023186 | A1* | 1/2013 | Motoshima et al. | 451/7 |

FOREIGN PATENT DOCUMENTS

| | | |
|---|---|---|
| JP | 2007-136560 | 6/2007 |
| JP | 2008-307630 | 12/2008 |
| KR | 10-2005-0030303 A | 3/2005 |
| KR | 10-2009-0052981 | 5/2009 |

* cited by examiner

POLISHING APPARATUS HAVING TEMPERATURE REGULATOR FOR POLISHING PAD

CROSS REFERENCE TO RELATED APPLICATIONS

This document claims priority to Japanese Application Number 2011-039586, filed Feb. 25, 2011, the entire contents of which are hereby incorporated by reference.

BACKGROUND OF THE INVENTION

1. Field of the Invention

The present invention relates to a polishing apparatus for polishing a substrate, such as a semiconductor wafer, by bringing the substrate into sliding contact with a polishing pad, and more particularly to a polishing apparatus having a mechanism for regulating a surface temperature of the polishing pad.

2. Description of the Related Art

CMP (Chemical Mechanical Polishing) apparatus is used in a process of polishing a surface of a substrate in semiconductor device fabrication. The CMP apparatus is designed to hold and rotate the substrate by a top ring and press the substrate against a polishing pad on a rotating polishing table to polish the surface of the substrate. During polishing, a polishing liquid (e.g., slurry) is supplied onto the polishing pad, so that the surface of the substrate is planarized by a chemical action of the polishing liquid and a mechanical action of abrasive grains contained in the polishing liquid.

A polishing rate of the substrate depends not only on a polishing load on the substrate against the polishing pad, but also on a surface temperature of the polishing pad. This is because the chemical action of the polishing liquid on the substrate depends on the temperature. Thus, it is important for the semiconductor device fabrication to maintain an optimum surface temperature of the polishing pad during substrate polishing in order to increase the polishing rate and keep it constant.

FIG. 13 is a schematic view of a pad temperature regulator for regulating the surface temperature of the polishing pad. This pad temperature regulator includes a pad contact element 100 that is placed in contact with a polishing pad 102. The polishing pad 102 is secured to an upper surface of a polishing table 101 and is rotated in a direction indicated by arrow together with the polishing table 101. Liquid flows through the pad contact element 100, so that the surface temperature of the polishing pad 102 is regulated by heat exchange between the liquid and the polishing pad 102.

FIG. 14 is a perspective view of the pad contact element 100 shown in FIG. 13. The pad contact element 100 includes a passage-forming member 90 having a liquid passage formed therein and a cover member 91 secured to the passage-forming member 90. The cover member 91 has a liquid inlet 93 and a liquid outlet 94. The cover member 91 is fixed to an upper portion of the passage-forming member 90 by a plurality of bolts 92. The cover member 91 is made of PVC (polyvinyl chloride), and the passage-forming member 90 is made of sintered SiC (sintered silicon carbide).

FIG. 15 is a plan view of the passage-forming member 90 shown in FIG. 14, and FIG. 16 is a cross-sectional view taken along line A-A shown in FIG. 14. A partition 95 is provided in the passage-forming member 90, and a liquid passage 99 is formed on both sides of the partition 95. A temperature-controlled liquid is introduced into the pad contact element 100 through the liquid inlet 93, flows through the liquid passage 99 in direction indicated by arrow shown in FIG. 15, and is discharged from the pad contact element 100 through the liquid outlet 94. The surface of the polishing pad 102 is maintained at a predetermined target temperature by the heat exchange between the liquid flowing through the pad contact element 100 and the polishing pad 102.

SUMMARY OF THE INVENTION

In order to improve throughput of substrate polishing process, it is necessary to raise the surface temperature of the polishing pad to the target temperature as rapidly as possible. Therefore, it is an object of the present invention to provide a polishing apparatus having an improved pad contact element capable of increasing the pad surface temperature to the target temperature more rapidly than the conventional pad contact element.

One aspect of the present invention for achieving the above object is to provide an apparatus for polishing a substrate by bringing the substrate into sliding contact with a polishing pad. The apparatus comprises: a polishing table configured to support the polishing pad; a top ring configured to press the substrate against the polishing pad on the polishing table; and a pad temperature regulator configured to regulate a surface temperature of the polishing pad. The pad temperature regulator includes a pad contact element brought into contact with a surface of the polishing pad, and a liquid supply system configured to supply a temperature-controlled liquid to the pad contact element. The pad contact element has a space therein and a partition that divide the space into a first liquid passage and a second liquid passage. The first liquid passage and the second liquid passage are connected in series. The first liquid passage is in communication with a liquid inlet coupled to the liquid supply system. The second liquid passage is in communication with a liquid outlet coupled to the liquid supply system. At least one baffle substantially perpendicular to a radial direction of the polishing table is provided in each of the first liquid passage and the second liquid passage.

Another aspect of the present invention is to provide an apparatus for polishing a substrate by bringing the substrate into sliding contact with a polishing pad. The apparatus comprises: a polishing table configured to support the polishing pad; a top ring configured to press the substrate against the polishing pad on the polishing table; and a pad temperature regulator configured to regulate a surface temperature of the polishing pad. The pad temperature regulator includes a pad contact element brought into contact with a surface of the polishing pad, and a liquid supply system configured to supply a temperature-controlled liquid to the pad contact element. The pad contact element has a liquid passage therein. The liquid passage is in communication with a liquid inlet and a liquid outlet coupled to the liquid supply system. At least one baffle substantially perpendicular to a radial direction of the polishing table is provided in the liquid passage.

According to the present invention, the liquid in the pad contact element flows along the baffle in the rotating direction of the polishing pad and in the opposite direction alternately. Therefore, the efficiency of the heat exchange between the polishing pad and the liquid is improved. As a result, the surface temperature of the polishing pad can be increased to a predetermined target temperature rapidly.

DETAILED DESCRIPTION OF THE PREFERRED EMBODIMENTS

Figure 1:
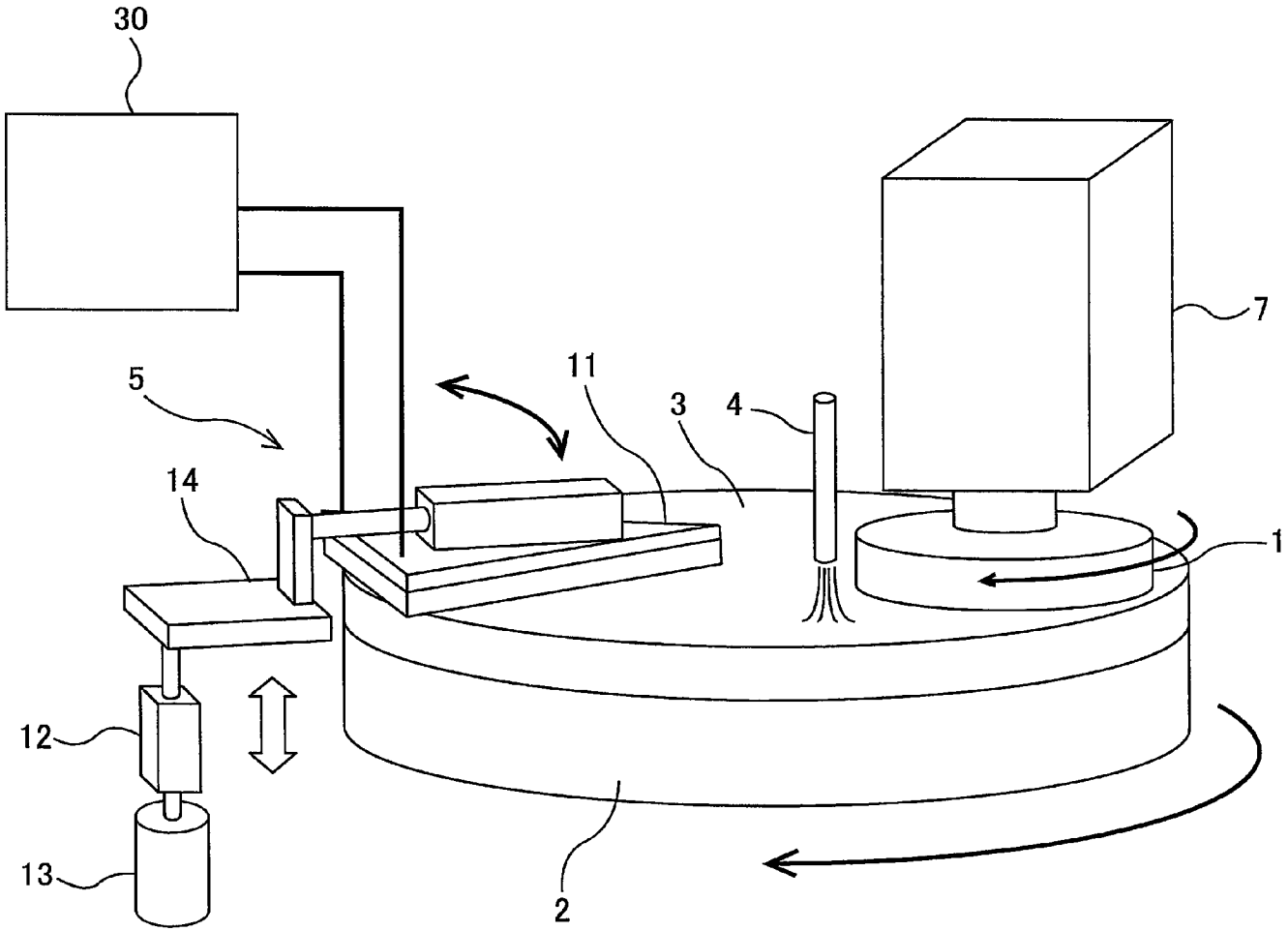
FIG. 1 is a schematic view of a polishing apparatus according to an embodiment of the present invention.

Embodiments of the present invention will be described below with reference to the drawings. FIG. 1 is a schematic view of a polishing apparatus according to an embodiment of the present invention. As shown in FIG. 1, the polishing apparatus includes a top ring 1 for holding and rotating a substrate (e.g., a semiconductor wafer), a polishing table 2 for supporting a polishing pad 3 thereon, a polishing liquid supply mechanism 4 for supplying a polishing liquid (e.g., slurry) onto a surface of the polishing pad 3, and a pad temperature regulator 5 for regulating a surface temperature of the polishing pad 3.

The top ring 1 is supported by a polishing head support arm 7, which is provided with a pneumatic cylinder and a motor (not shown) that move the top ring 1 vertically and rotate the top ring 1 about its own axis. The substrate is held on a lower surface of the top ring 1 by vacuum suction or other means. The polishing table 2 is coupled to a motor (not shown), so that the polishing table 2 can rotate in a direction indicated by arrow.

The substrate, to be polished, is held by the top ring 1 and further rotated by the top ring 1. The polishing pad 3 is rotated about its own axis together with the polishing table 2. In this state, the polishing liquid is supplied onto a surface of the polishing pad 3 from the polishing liquid supply mechanism 4 and a surface of the substrate is pressed against the surface of the polishing pad 3 (i.e., substrate polishing surface). The surface of the substrate is polished by sliding contact between the polishing pad 3 and the substrate in the presence of the polishing liquid.

The pad temperature regulator 5 includes: a pad contact element 11 that is brought into contact with the surface of the polishing pad 3; and a liquid supply system 30 for supplying a temperature-controlled liquid to the pad contact element 11. The pad contact element 11 is coupled to a pneumatic cylinder 12 through an arm 14. This pneumatic cylinder 12 serves as an elevating mechanism for raising and lowering the pad contact element 11. The pad contact element 11 is further coupled to a motor 13 serving as a moving mechanism, so that the pad contact element 11 is moved between a predetermined raised position located above the polishing pad 3 and a predetermined idling position located radially outwardly of the polishing table 2.

Figure 2:
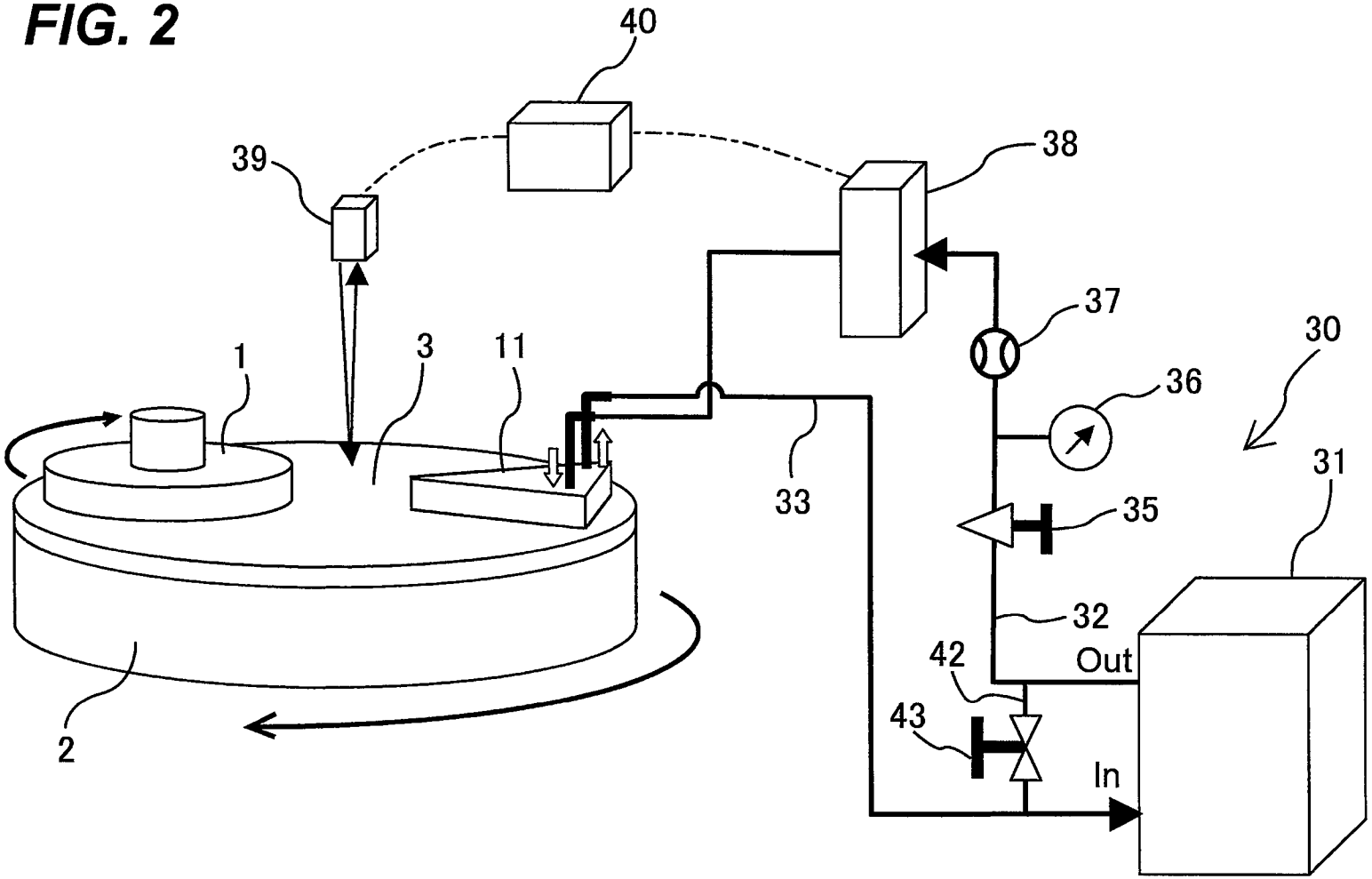
FIG. 2 is a schematic view showing a liquid supply system for supplying a liquid to a pad contact element.

FIG. 2 is a schematic view showing the liquid supply system 30 for supplying the liquid to the pad contact element 11. This liquid supply system 30 has a liquid supply tank 31, a supply line 32, and a return line 33. The liquid supply tank 31 and the pad contact element 11 are coupled to each other via the supply line 32 and the return line 33. The liquid, as a heating medium, is supplied to the pad contact element 11 from the liquid supply tank 31 through the supply line 32, and is returned from the pad contact element 11 to the liquid supply tank 31 through the return line 33. In this manner, the liquid circulates between the liquid supply tank 31 and the pad contact element 11. The liquid supply tank 31 has a heater (not shown) for heating the liquid to a predetermined temperature.

The liquid supply system 30 further includes: a pressure regulator 35 for keeping pressure of the liquid, flowing through the supplying line 32, constant; a pressure-measuring device 36 for measuring the pressure of the liquid that has passed through the pressure regulator 35; a flowmeter 37 for measuring a flow rate of the liquid that has passed through the pressure regulator 35; a flow control valve 38 for controlling the flow rate of the liquid to be supplied to the pad contact element 11; a radiation thermometer 39 serving as a pad surface thermometer for measuring the surface temperature of the polishing pad 3; and a temperature controller 40 for controlling the flow control valve 38 based on the pad surface temperature measured by the radiation thermometer 39. The supply line 32 and the return line 33 communicate with each other through a communication line 42, but normally this communication line 42 is closed by a hand valve 43.

The radiation thermometer 39 is designed to measure the surface temperature of the polishing pad 3 in a noncontact manner (i.e., without contacting the polishing pad 3) and send measured value of the surface temperature to the temperature controller 40. This temperature controller 40 controls the flow control valve 38 based on the measured value of the surface temperature of the polishing pad 3 such that the surface temperature of the polishing pad 3 is kept at a preset target temperature. The flow control valve 38 operates based on a control signal from the temperature controller 40 so as to regulate the flow rate of the liquid to be supplied to the pad contact element 11. The surface temperature of the polishing pad 3 is regulated by the heat exchange between the liquid flowing through the pad contact element 11 and the polishing pad 3.

By performing such a feedback control, the surface temperature of the polishing pad 3 is maintained at the predetermined target temperature. A PID controller (Proportional-Integral-Derivative controller) can be used as the temperature controller 40. The target temperature of the polishing pad 3 is determined depending on a type of the substrate or a polishing process. The determined target temperature is inputted in advance to the temperature controller 40.

As described above, the surface temperature of the polishing pad 3 is controlled by regulating the flow rate of the liquid to be supplied to the pad contact element 11. Water is used as the liquid (i.e., the heating medium) to be supplied to the pad contact element 11. The water is heated by the heater of the liquid supply tank 31 to, for example, about 80° C. In order to increase the surface temperature of the polishing pad 3 more rapidly, a silicone oil may be used as the heating medium. In this case, the silicone oil is heated by the heater of the liquid supply tank 31 to 100° C. or more (for example, about 120° C.).

Figure 3:
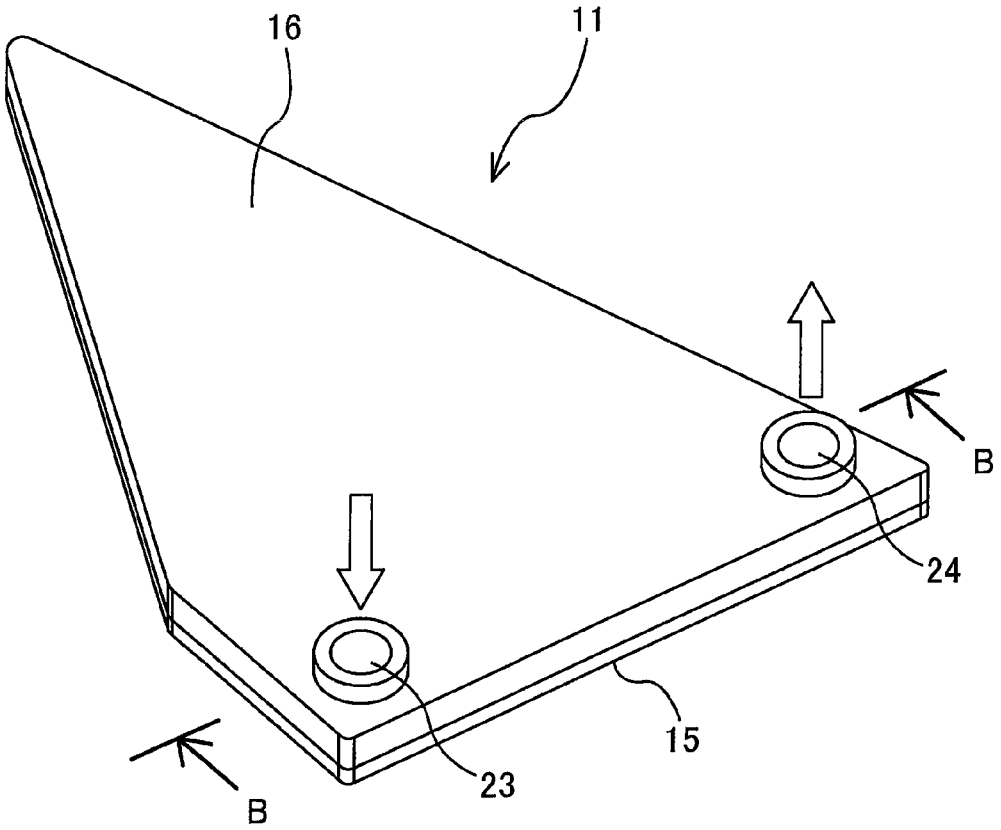
FIG. 3 is a perspective view of the pad contact element.

FIG. 3 is a perspective view of the pad contact element 11. As shown in FIG. 3, the pad contact element 11 includes: a plate member 15 having a contact surface which is brought into contact with the surface of the polishing pad 3; and a passage-forming member 16 having passages for the liquid formed therein. The plate member 15 is secured to a lower portion of the passage-forming member 16. A liquid inlet 23 and a liquid outlet 24 are formed on an upper surface of the passage-forming member 16.

Figure 4:
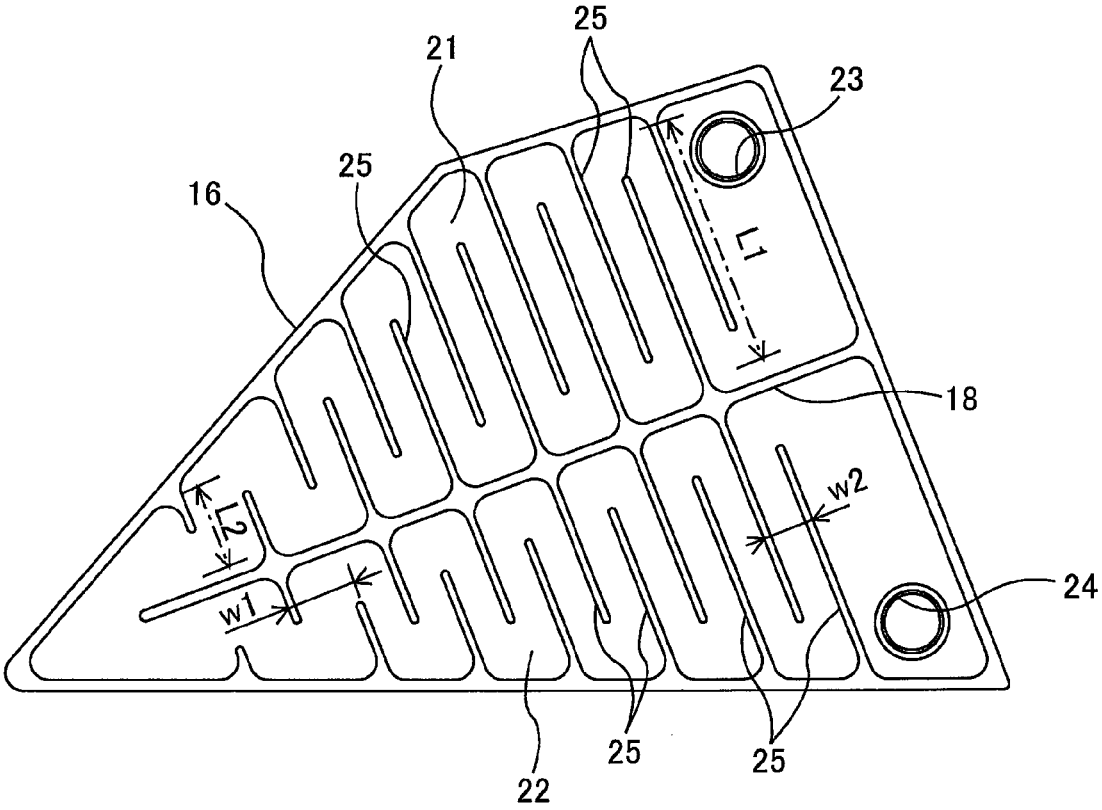
FIG. 4 is a view of a passage-forming member shown in FIG. 3 as viewed from below.
Figure 5:
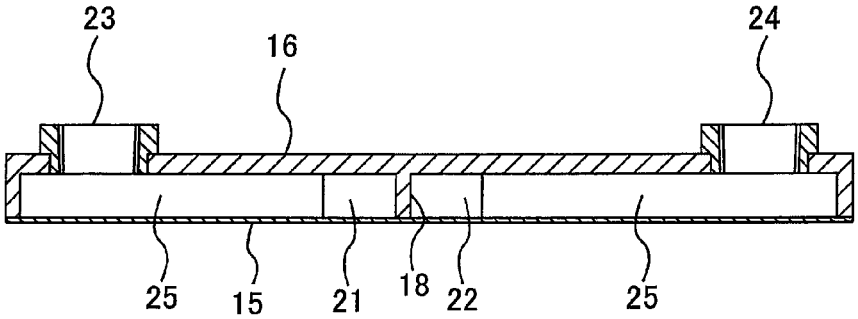
FIG. 5 is a cross-sectional view taken along line B-B shown in FIG. 3.

FIG. 4 is a view of the passage-forming member 16 shown in FIG. 3 as viewed from below, and FIG. 5 is a cross-sectional view taken along line B-B shown in FIG. 3. A partition 18 is provided in the passage-forming member 16. This partition 18 extends in a radial direction of the polishing table 2 so as to divide an interior space of the passage-forming member 16 into a first liquid passage 21 and a second liquid passage 22. The first liquid passage 21 and the second liquid passage 22 are connected in series. More specifically, a downstream end of the first liquid passage 21 is connected to an upstream end of the second liquid passage 22. The first liquid passage 21 communicates with the liquid inlet 23, and the second liquid passage 22 communicates with the liquid outlet 24.

The liquid from the liquid supply system 30 is supplied into the first liquid passage 21 through the liquid inlet 23. The liquid flows through the first liquid passage 21 and the second liquid passage 22 in this order, so that the heat exchange is performed between the liquid and the polishing pad 3. The liquid is discharged through the liquid outlet 24 and returned to the liquid supply tank 31 of the liquid supply system 30.

A plurality of (13 in FIG. 4) baffles 25 are provided in the first liquid passage 21. These baffles 25 are constructed by plates which are substantially perpendicular to the partition 18 and arranged in parallel to each other. The baffles 25 are staggered alternately to form the first liquid passage 21 into a zigzag passage. The partition 18 extends in the radial direction of the circular polishing table 2 (or the circular polishing pad 3) and the baffles 25 extend in approximately a circumferential direction of the polishing table 2. Therefore, the liquid in the first liquid passage 21 flows in a rotating direction of the polishing table 2 and in a direction against the rotating direction of the polishing table 2 alternately.

Similarly, a plurality of (13 in FIG. 4) baffles 25 are provided in the second liquid passage 22 so as to form the second liquid passage 22 into a zigzag passage. The liquid in the second liquid passage 22 flows in the rotating direction of the polishing table 2 and in the direction against the rotating direction of the polishing table 2 alternately. While the partition 18 and the baffles 25 are formed integrally with the passage-forming member 16 in this embodiment, they may be formed as separated elements.

The plate member 15 is formed by CVD (Chemical Vapor Deposition) in which SiC (silicon carbide) is deposited in the form of plate. Use of the CVD technique can provide the thin plate member 15. For example, the plate member 15 shown in FIG. 5 has a thickness ranging from 0.7 mm to 1.0 mm, while a contact portion of the conventional passage-forming member in FIG. 14 through FIG. 16 has a thickness of about 3 mm. Further, the SiC formed by CVD has a better thermal conductivity than sintered SiC. Therefore, use of the thin SiC plate member 15 formed by CVD can improve the efficiency of the heat exchange between the liquid and the polishing pad 3. From the viewpoint of manufacturing cost, the plate member 15 may be made from sintered SiC. In this case also, it is preferable that the plate member 15 be as thin as possible. For example, the plate member 15 formed by the sintered SiC may have a thickness of about 1.0 mm.

The passage-forming member 16 is made of ceramic. This passage-forming member 16 has a vessel shape having a lower open end, which is closed by the plate member 15. The passage-forming member 16 and the plate member 15 are joined to each other by an adhesive. Fritted glass can be used as the adhesive. The fitted glass is an adhesive based on a glass bonding technique and can join ceramic to SiC. The fitted glass has approximately the same coefficient of linear expansion as that of ceramic and SiC. Therefore, by using the fritted glass, thermal stress can be reduced.

Due to heat of the liquid flowing through the pad contact element 11, the passage-forming member 16 and the plate member 15 are deformed to some degree. In order to minimize the effect of such thermal expansion, it is preferable that the ceramic used to form the passage-forming member 16 have substantially the same coefficient of linear expansion as that of SiC forming the plate member 15.

The plate member 15 is secured not only to a peripheral wall of the passage-forming member 16 and the partition 18, but also to the baffles 25. Therefore, a mechanical strength of the thin plate member 15 is reinforced and deformation of the plate member 15 due to liquid pressure is prevented. Because the plate member 15 is supported by the plural baffles 25, the plate member 15 can be thin. As a result, the efficiency of the heat exchange can be increased.

The above-described liquid inlet 23 and the liquid outlet 24 are provided on the upper portion of the passage-forming member 16. Both of the liquid inlet 23 and the liquid outlet 24 are located above a peripheral portion of the polishing pad 3. The liquid inlet 23 is arranged downstream of the liquid outlet 24 with respect to the rotating direction of the polishing table 2 (polishing pad 3). This is for the reason of increasing the efficiency of the heat exchange between the liquid and the polishing pad 3 by passing the liquid in the direction opposite to the rotating direction of the polishing pad 3. While the first liquid passage 21 and the second liquid passage 22 are in the form of the zigzag passages, these passages 21 and 22 as a whole extend in the radial direction of the polishing pad 3. Therefore, the liquid travels in the radial direction of the polishing pad 3 while meandering through the first liquid passage 21 and the second liquid passage 22.

During polishing of the substrate, the polishing pad 3 rotates about its own axis. As a result, the temperature of the peripheral portion of the polishing pad 3 becomes lower than the temperature of a central portion of the polishing pad 3. Thus, there exists a temperature gradient on the surface of the polishing pad 3 along the radial direction thereof during polishing of the substrate. Since this temperature gradient may affect an adverse influence on polishing of the substrate, it is preferable to eliminate the temperature gradient of the polishing pad 3. Thus, in order to eliminate the temperature gradient, the pad contact element 11 has a width that becomes smaller gradually as its radial position comes closer to the center of the polishing table 2 (polishing pad 3).

As shown in FIG. 4, the first liquid passage 21 and the second liquid passage 22 form the zigzag passages through which the liquid meanders. These zigzag passages have a plurality of passage sections that are substantially perpendicular to the radially-extending partition 18. A length L1 (see FIG. 4) of the passage section located at the peripheral side of the polishing pad 3 is longer than a length L2 of the passage section located at the central side of the polishing pad 3. More specifically, the length of the passage section increases gradually from the central side to the peripheral side of the polishing pad 3. Therefore, the heat exchange is performed more actively in the peripheral portion than in the central portion of the polishing pad 3, and as a result the temperature gradient on the surface of the polishing pad 3 can be removed. In FIG. 3 through FIG. 5, the pad contact element 11 has a shape that is not symmetrical about its center line, i.e., the partition 18. However, the pad contact element 11 may have a fan shape that is symmetrical about the partition 18.

An average speed of the liquid flowing through the first liquid passage 21 and the second liquid passage 22 is preferably at least 0.7 m/sec and less than 1.0 m/sec. This is because, if the average speed of the liquid exceeds 1.0 m/sec, then cavitation is likely to occur and as a result the efficiency of the heat exchange decreases. In order to limit the liquid average speed to less than 1.0 m/sec, it is preferable to increase a cross-sectional area of the zigzag passage located at the central side of the polishing pad 3. As shown in FIG. 4, a width w1 of the zigzag passage at the central side of the polishing pad 3 is larger than a width w2 of the zigzag passage at the peripheral side of the polishing pad 3. With this structure, the average speed of the liquid is lowered, and therefore the cavitation can be prevented.

The liquid is introduced into the pad contact element 11 through the liquid inlet 23, and flows toward the center of the polishing table 2 (polishing pad 3) while meandering through the first liquid passage 21. The liquid changes its travel direction at the downstream end of the first liquid passage 21, and flows radially outwardly while meandering through the second liquid passage 22. Because the liquid flows along the plurality of baffles 25 in the circumferential direction of the polishing pad 3, the efficiency of the heat exchange between the polishing pad 3 and the liquid can be increased. That is, because the liquid flows in the direction opposite to the rotating direction of the polishing pad 3, the efficiency of the heat exchange between the liquid and the polishing pad 3 can be improved. Therefore, the surface temperature of the polishing pad 3 can be increased rapidly to the target temperature. As a result, the throughput of substrate processing can be improved.

Figure 6:
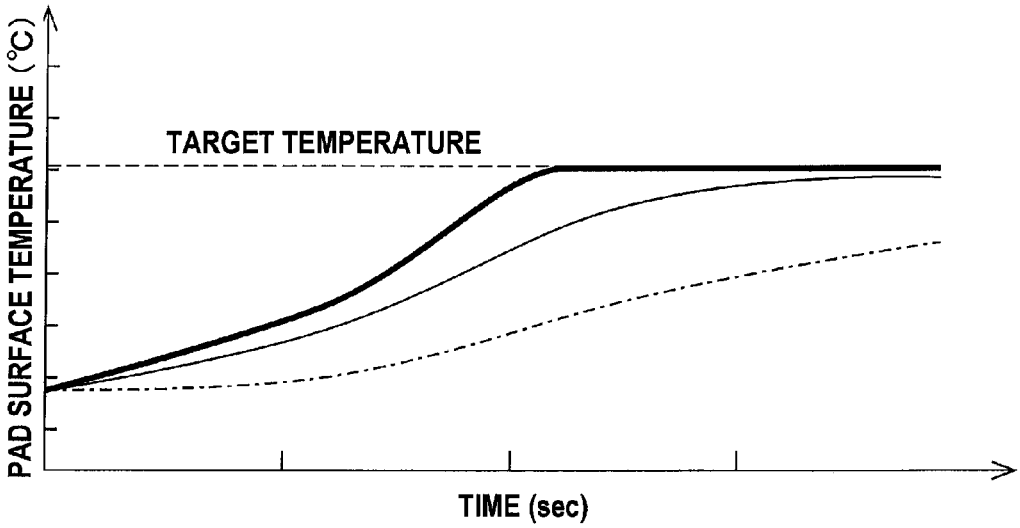
FIG. 6 is a graph showing experimental results of surface temperature measurement of the polishing pad.

FIG. 6 is a graph showing experimental results of surface temperature measurement of the polishing pad 3. In FIG. 6, a thick solid line represents a change in the surface temperature of the polishing pad 3 when using the pad contact element 11 shown in FIG. 3 through FIG. 5, a thin solid line represents a change in the surface temperature of the polishing pad 3 when using the conventional pad contact element shown in FIG. 14 through FIG. 16, and a chain line represents a change in the surface temperature of the polishing pad 3 when using no pad contact element.

Figure 14:
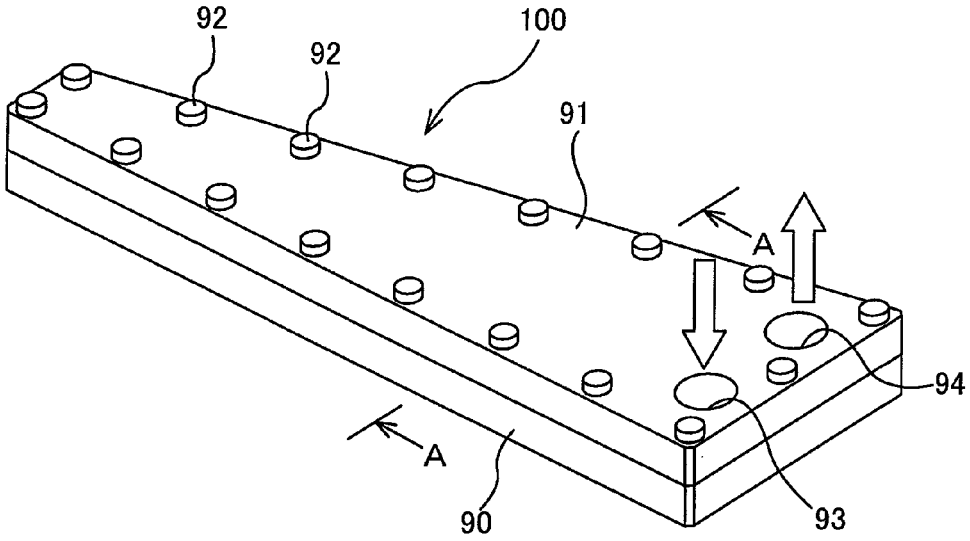
FIG. 14 PRIOR ART
FIG. 14 is a perspective view of a pad contact element shown in FIG. 13.
Figure 15:
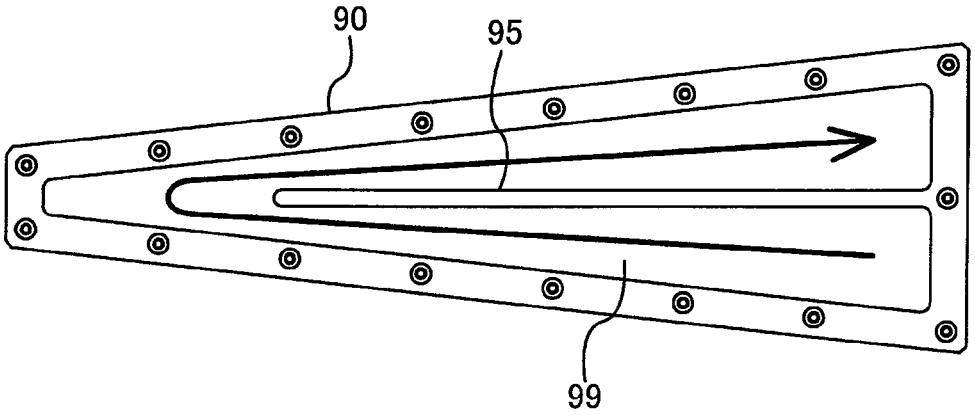
FIG. 15 PRIOR ART
FIG. 15 is a plan view of a passage-forming member of the pad contact element shown in FIG. 14.
Figure 16:
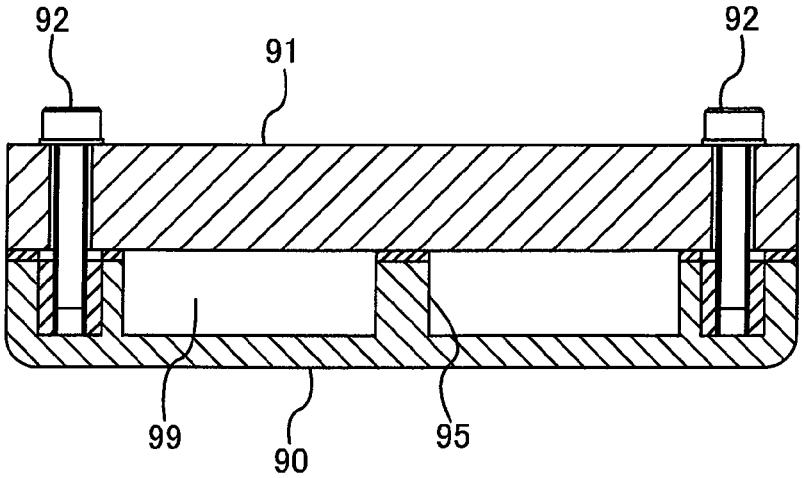
FIG. 16 PRIOR ART
FIG. 16 is a cross-sectional view taken along line A-A shown in FIG. 14.

The average speed of the liquid flowing through the conventional pad contact element shown in FIG. 14 through FIG. 16 was about 0.3 msec, while the average speed of the liquid flowing through the pad contact element 11 shown in FIG. 3 through FIG. 5 was about 0.7 msec. It can be seen from the graph in FIG. 6 that use of the pad contact element 11 according to the embodiment of the present invention can rapidly raise the surface temperature of the polishing pad 3 to the predetermined target temperature.

Polishing of the substrate is performed while regulating the surface temperature of the polishing pad 3 by the above-described pad temperature regulator 5. When polishing of the substrate is not performed, the pad contact element 11 is elevated by the pneumatic cylinder 12 so as to be separated from the surface (i.e., the polishing surface) of the polishing pad 3. This operation can prevent unwanted wear of a pad contact surface of the pad contact element 11. After polishing of the substrate is terminated, the arm 14 may be pivoted by the motor 13 to move the pad contact element 11 to the predetermined idling position.

During polishing, the substrate is held by the top ring 1 and pressed against the polishing pad 3. However, there are rare occasions when the substrate comes off the top ring 1 when polishing the substrate. If the substrate comes off the top ring 1, the substrate may impinge upon the pad contact element 11, damaging the pad contact element 11. In order to prevent such damage to the pad contact element 11, it is preferable to provide a substrate detecting sensor (not shown) on the pad contact element 11 or the arm 14 supporting the pad contact element 11 and to raise the pad contact element 11 by the pneumatic cylinder 12 when the substrate detecting sensor detects the substrate coming off the top ring 1.

Figure 7:
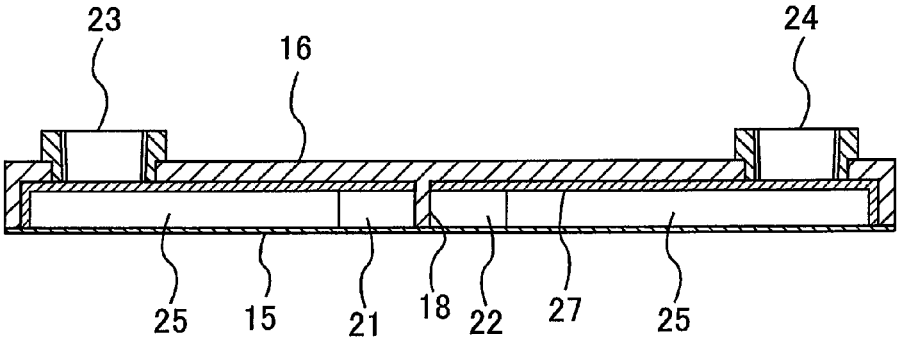
FIG. 7 is a view showing an example in which an inner surface of the passage-forming member is covered with a heat insulator.

In order to reduce heat radiation from the liquid through the ceramic-made passage-forming member 16, it is preferable, as shown in FIG. 7, to provide a heat insulator 27 covering the inner surface of the passage-forming member 1 defining the first liquid passage 21 and the second liquid passage 22. This heat insulator 27 is arranged so as to cover an upper portion and side portions of the inner surface of the passage-forming member 16. The heat insulator 27 to be used is a heat insulating sheet made of resin, a resin coating, or other possible means. By providing the heat insulator 27 on the inner surface of the passage-forming member 16, the heat radiation from the liquid flowing through the first liquid passage 21 and the second liquid passage 22 can be prevented.

Figure 8:
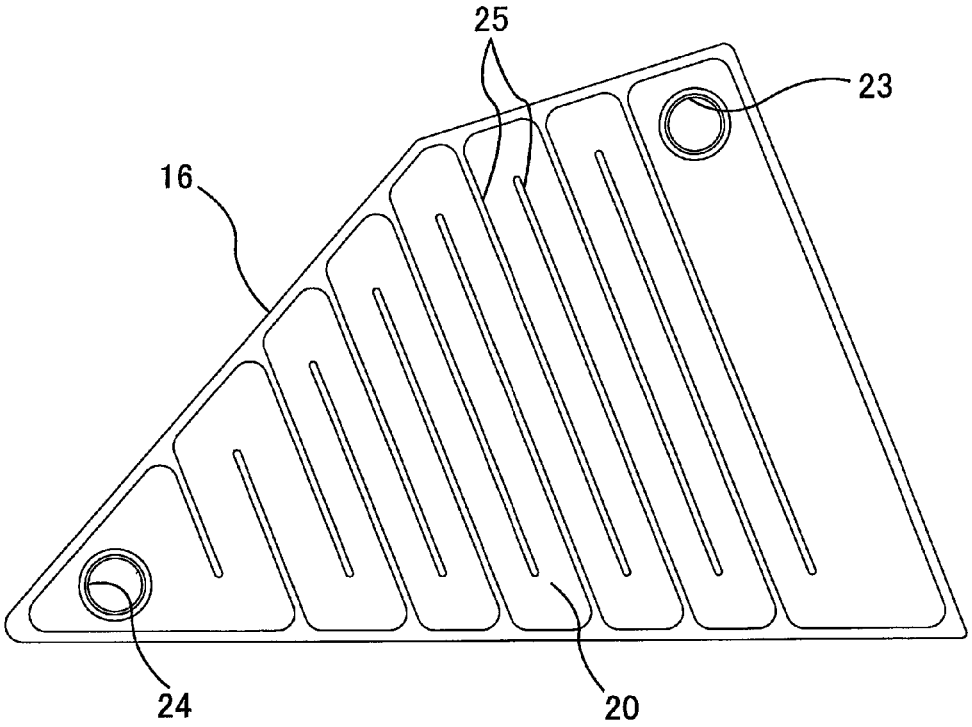
FIG. 8 is a view showing another example of the passage-forming member.

FIG. 8 is a view showing another example of the passage-forming member 16. The same structures in this example as those of the passage-forming member 16 shown in FIG. 3 through FIG. 5 will not be described again. In this example shown in FIG. 8, there is no partition in the passage-forming member 16. Therefore, only one liquid passage 20 is formed in the passage-forming member 16. In this liquid passage 20, there are provided plural baffles 25 that are substantially perpendicular to the radial direction of the polishing table 2 (polishing pad 3). These baffles 25 are staggered alternately so as to form the liquid passage 20 into a zigzag passage.

Liquid inlet 23 is connected to one end of the liquid passage 20, and liquid outlet 24 is connected to the other end of the liquid passage 20. The liquid inlet 23 is located above the peripheral portion of the polishing pad 3, while the liquid outlet 24 is located above the central portion of the polishing pad 3. In this example, the liquid flows into the liquid passage 20 through the liquid inlet 23, travels toward the center of the polishing pad while meandering through the liquid passage 20, and flows out the liquid passage 20 through the liquid outlet 24. Such flow of the liquid toward the center of the polishing pad 3 can remove the surface temperature gradient of the polishing pad 3 more rapidly.

Figure 9:
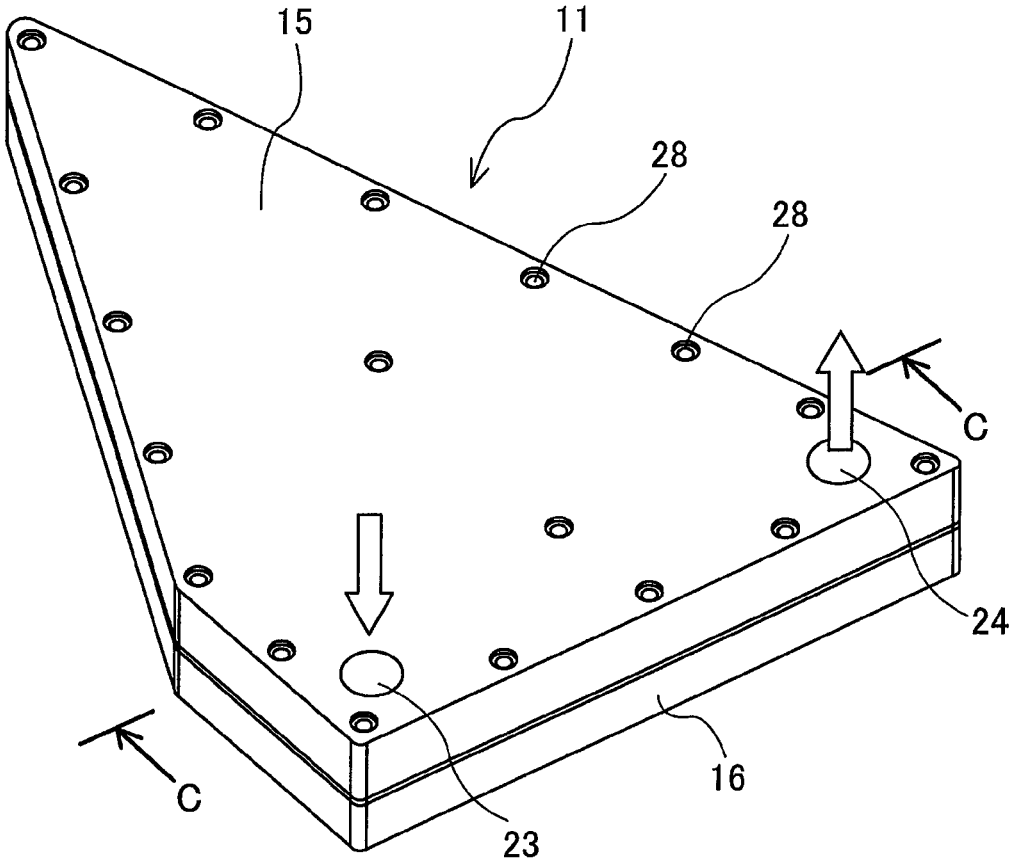
FIG. 9 is a perspective view showing another example of the pad contact element.
Figure 10:
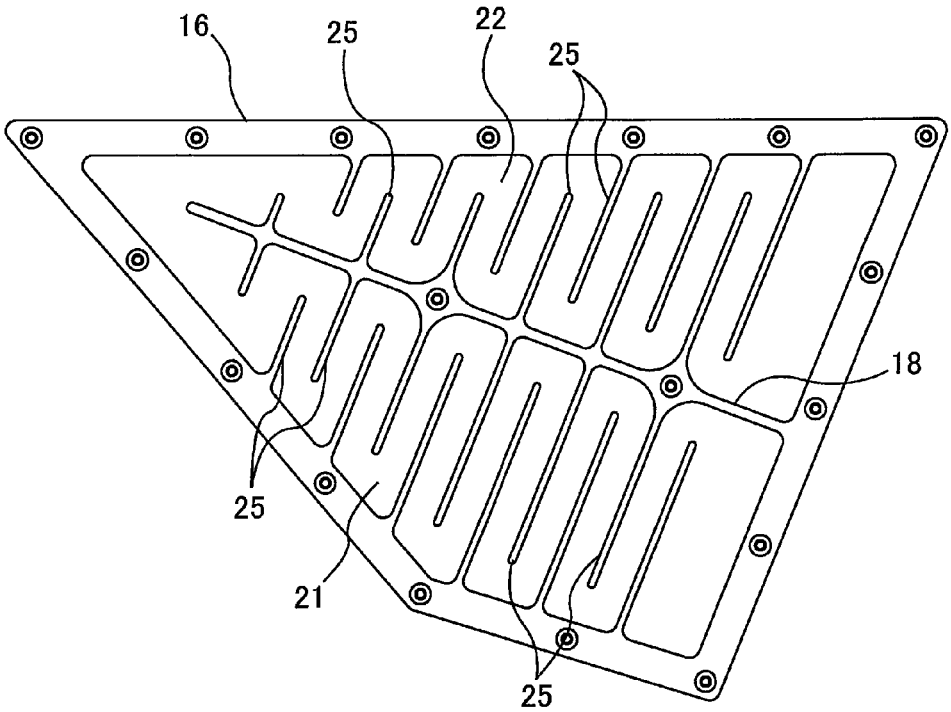
FIG. 10 is a view of the passage-forming member shown in FIG. 9 as viewed from above.
Figure 11:
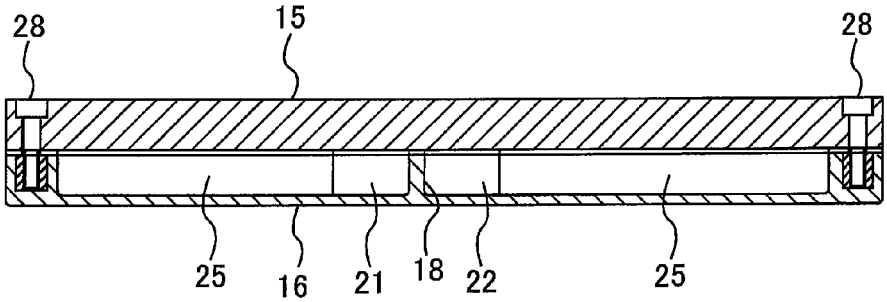
FIG. 11 is a cross-sectional view taken along line C-C shown in FIG. 9.

FIG. 9 is a perspective view showing another example of the pad contact element 11. The same structures as those in FIG. 3 through FIG. 5 will be denoted by the same reference numerals and the repetitive descriptions will be omitted. In the example shown in FIG. 9, plate member 15 is arranged on passage-forming member 16. Therefore, a lower surface of the passage-forming member 16 is brought into contact with the surface of the polishing pad 3. FIG. 10 is a view of the passage-forming member 16 shown in FIG. 9 as viewed from above, and FIG. 11 is a cross-sectional view taken along line C-C shown in FIG. 9.

The plate member 15 is secured to the passage-forming member 16 by a plurality of bolts or screws represented by reference numeral 28. The plate member 15 is made of PVC (polyvinyl chloride), and the passage-forming member 16 is made of sintered SiC (sintered silicon carbide). The passage-forming member 16 has a lower portion with a thickness of about 2 mm. The liquid inlet 23 connected to the first liquid passage 21 and the liquid outlet 24 connected to the second liquid passage 22 are formed on the plate member 15. The first liquid passage 21 and the second liquid passage 22 have substantially the same shape as the shape of the first liquid passage 21 and the second liquid passage 22 in the above-described example shown in FIG. 4. Therefore, in this example also, it is possible to increase the surface temperature of the polishing pad 3 rapidly.

Figure 12:
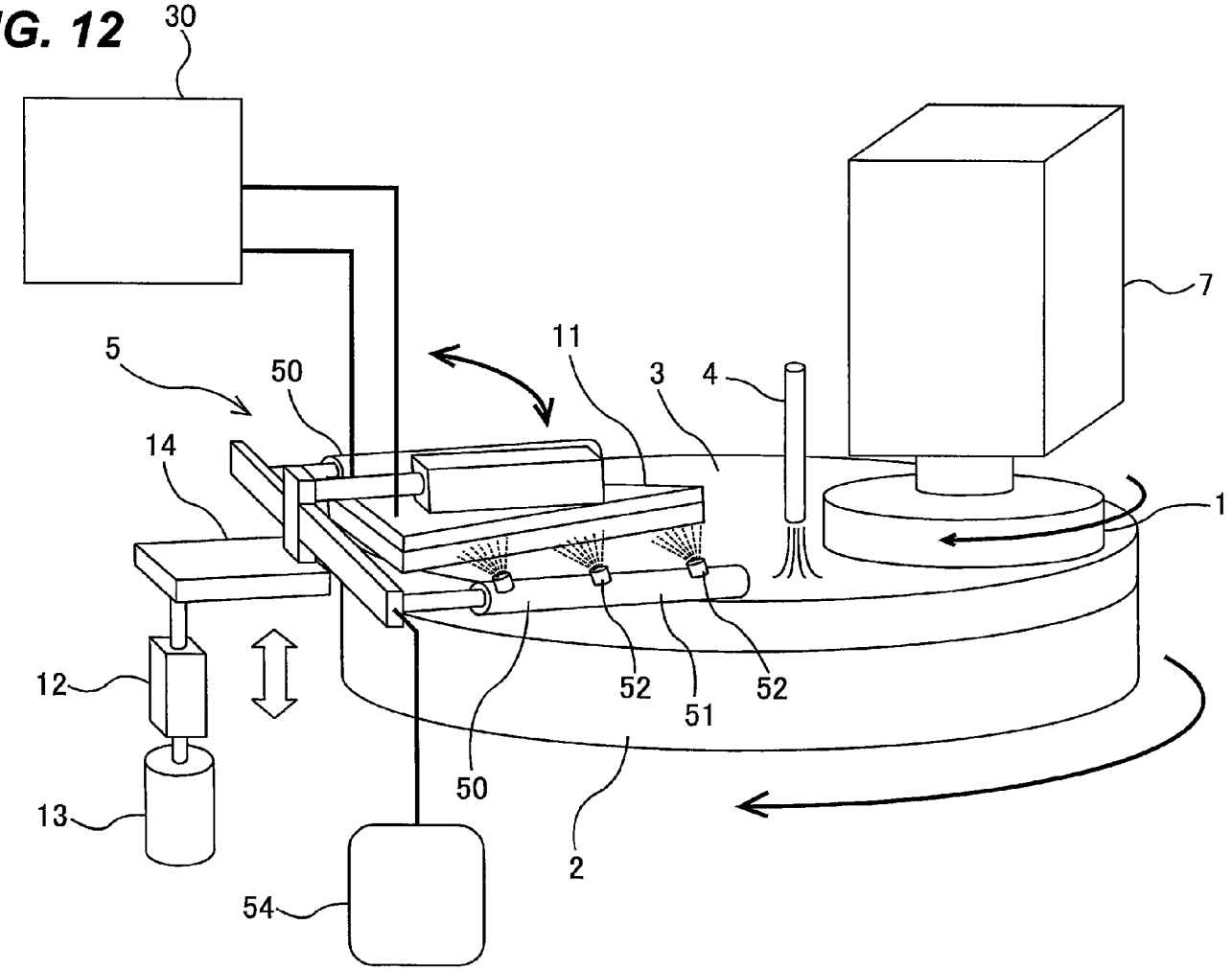
FIG. 12 is a schematic view of the polishing apparatus having a cleaning mechanism for cleaning the pad contact element.
Figure 13:
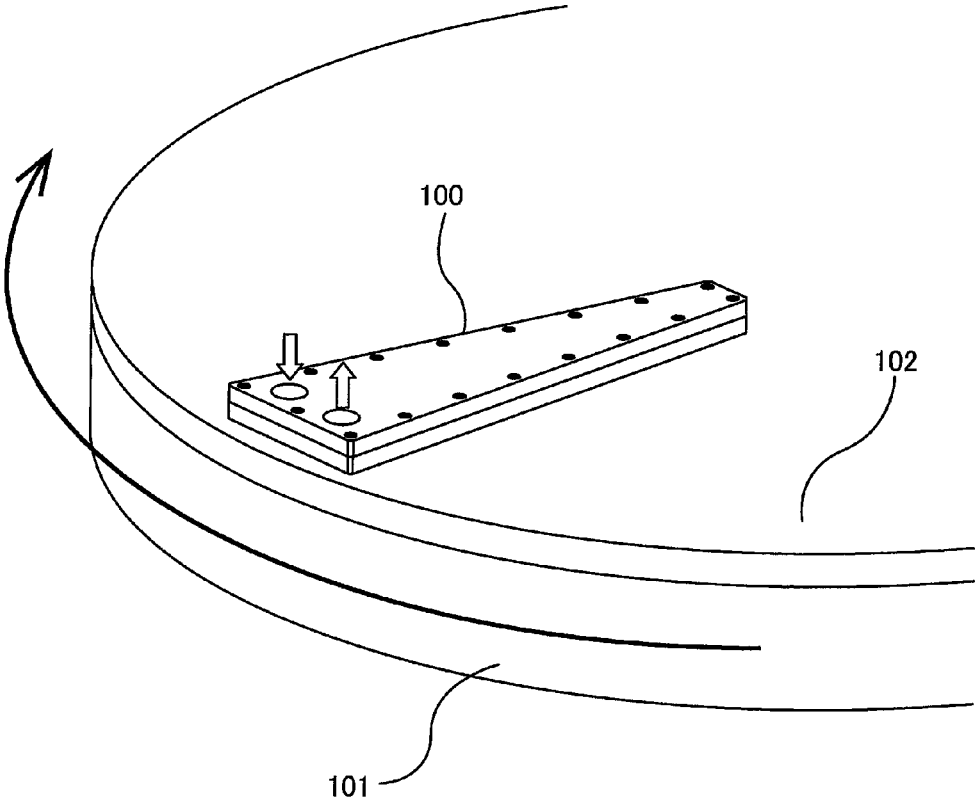
FIG. 13 PRIOR ART
FIG. 13 is a schematic view of a conventional pad temperature regulator.

FIG. 12 is a schematic view of the polishing apparatus having cleaning mechanisms 50 and 50 for cleaning the pad contact element 11 by supplying a cleaning liquid onto the pad contact element 11. The cleaning mechanisms 50 and 50 are provided on both sides of the pad contact element 11 and are secured to the arm 14. The cleaning mechanisms 50 and 50 are elevated and lowered together with the pad contact element 11 by the pneumatic cylinder 12 serving as an elevating mechanism. Further, the cleaning mechanisms 50 and 50 are rotated together with the pad contact element 11 by the motor 13.

Each cleaning mechanism 50 includes: a header tube 51 which is in communication with a cleaning liquid supply source 54; and spray nozzles 52 provided on the header tube 51. This header tube 51 is arranged along a side surface of the pad contact element 11, and the spray nozzles 52 are arranged so as to face the side surface of the pad contact element 11. A cleaning liquid is supplied from the cleaning liquid supply source 54 and is ejected from the spray nozzles 52 toward both side surfaces of the pad contact element 11, whereby the polishing liquid (e.g., slurry) can be removed from the side surfaces of the pad contact element 11. One example of the cleaning liquid to be used is pure water. It is preferable to perform cleaning of the pad contact element 11 when the pad contact element 11 is in the idling position.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. An apparatus for polishing a substrate by bringing the substrate into sliding contact with a polishing pad, said apparatus comprising:

a polishing table configured to be rotatable about its axis and support the polishing pad;

a top ring configured to press the substrate against the polishing pad on said polishing table; and a pad temperature regulator configured to regulate a surface temperature of the polishing pad and provided above said polishing table, wherein said pad temperature regulator includes a pad contact element brought into contact with a surface of the polishing pad, and a liquid supply system configured to supply a temperature-controlled liquid to said pad contact element, wherein said pad contact element has a space therein and a partition that divide the space into a first liquid passage and a second liquid passage, wherein said first liquid passage and said second liquid passage are connected in series at a location above a central portion of said polishing table, wherein said first liquid passage is in communication with a liquid inlet coupled to said liquid supply system, wherein said second liquid passage is in communication with a liquid outlet coupled to said liquid supply system, wherein said partition extends in a radial direction of said polishing table, and wherein plural baffles, extending substantially perpendicular to said partition and in approximately a circumferential direction of said polishing table, are provided in each of said first liquid passage and said second liquid passage, said plural baffles being staggered alternately to form each of said first liquid passage and said second liquid passage into a zigzag passage that extends alternately in a rotating direction of the polishing table and in a direction against the rotating direction, wherein said plural baffles comprise first baffles and second baffles, said first baffles being connected to said partition and being substantially perpendicular to said partition, said second baffles being connected to a side of said pad contact element, and wherein said first baffles and said second baffles are staggered alternately along a radial direction of said polishing table.

2. The apparatus according to claim 1, wherein said plural baffles are arranged in parallel to each other.

3. The apparatus according to claim 1, wherein said zigzag passage is wider at a central side than at a peripheral-side of the polishing pad.

4. The apparatus according to claim 1, wherein said liquid inlet and said liquid outlet are located above a peripheral portion of the polishing pad.

5. The apparatus according to claim 1, wherein said pad contact element includes:

a plate member that is brought into contact with the polishing pad; and a passage-forming member having said partition therein.

6. The apparatus according to claim 5, wherein said passage-forming member defining said first liquid passage and said second liquid passage has an inner surface covered with a heat insulator.

7. The apparatus according to claim 1, wherein said pad contact element includes:

a passage-forming member having said partition and a contact surface brought into contact with the polishing pad; and a plate member covering said passage-forming member.

8. The apparatus according to claim 1, wherein said pad temperature regulator further includes:

an elevating mechanism configured to raise and lower said pad contact element; and a moving mechanism configured to move said pad contact element between a predetermined raised position located above the polishing pad and a predetermined idling position located radially outwardly of said polishing table.

9. The apparatus according to claim 1, wherein said pad temperature regulator further includes:

a cleaning mechanism configured to clean said pad contact element.

10. An apparatus for polishing a substrate by bringing the substrate into sliding contact with a polishing pad, said apparatus comprising:

a polishing table configured to support the polishing pad;

a top ring configured to press the substrate against the polishing pad on said polishing table; and a pad temperature regulator configured to regulate a surface temperature of the polishing pad, said pad temperature regulator being disposed above said polishing table, wherein said pad temperature regulator includes:

a pad contact element brought into contact with a surface of the polishing pad, a liquid supply system configured to supply a temperature-controlled liquid to said pad contact element, a header tube extending along a side surface of said pad contact element, said header tube being connected to a cleaning liquid supply source, at least one cleaning-liquid spray nozzle provided on said header tube and communicating with said header tube, said at least one cleaning-liquid spray nozzle having a liquid outlet facing the side surface of said pad contact element, wherein said pad contact element has a space therein and a partition that divides the space into a first liquid passage and a second liquid passage, wherein said first liquid passage and said second liquid passage are connected in series, wherein said first liquid passage is in communication with a liquid inlet coupled to said liquid supply system, wherein said second liquid passage is in communication with a liquid outlet coupled to said liquid supply system, wherein said partition extends in a radial direction of said polishing table, and wherein at least one baffle, extending substantially perpendicular to the radial direction of said polishing table, is provided in each of said first liquid passage and said second liquid passage.

11. The apparatus according to claim 10, wherein said at least one cleaning-liquid spray nozzle comprises a plurality of cleaning-liquid spray nozzles arranged along the side surface of said pad contact element.

* * * * *